US010967422B2

(12) United States Patent
Ogura et al.

(10) Patent No.: US 10,967,422 B2
(45) Date of Patent: Apr. 6, 2021

(54) PROPERTY ADJUSTING SYSTEM AND PROPERTY ADJUSTING METHOD FOR KNEADED SAND

(71) Applicant: SINTOKOGIO, LTD., Nagoya (JP)

(72) Inventors: Yuichi Ogura, Toyokawa (JP); Hisashi Harada, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 260 days.

(21) Appl. No.: 16/096,134

(22) PCT Filed: Feb. 13, 2017

(86) PCT No.: PCT/JP2017/005163
§ 371 (c)(1),
(2) Date: Oct. 24, 2018

(87) PCT Pub. No.: WO2017/195423
PCT Pub. Date: Nov. 16, 2017

(65) Prior Publication Data

US 2019/0134702 A1 May 9, 2019

(30) Foreign Application Priority Data

May 11, 2016 (JP) ..... JP2016-094971

(51) Int. Cl.
*B22C 5/04* (2006.01)
*B22C 1/00* (2006.01)
(Continued)

(52) U.S. Cl.
CPC ..... *B22C 5/0472* (2013.01); *B22C 1/00* (2013.01); *B22C 5/08* (2013.01); *B22C 5/16* (2013.01); *B22C 9/02* (2013.01); *B22C 19/04* (2013.01)

(58) Field of Classification Search
CPC ..... B22C 5/0472
(Continued)

(56) References Cited

U.S. PATENT DOCUMENTS 2,791,120 A * 5/1957 Dietert ..... B22C 5/08 366/10
2,958,107 A 11/1960 Hartley
(Continued)

FOREIGN PATENT DOCUMENTS

JP H05-212490 A 8/1993
JP H07-171657 A 7/1995
(Continued)

OTHER PUBLICATIONS

Mar. 21, 2017 International Search Report issued in International Patent Application No. PCT/JP2017/005163.

*Primary Examiner* — David L Sorkin
(74) *Attorney, Agent, or Firm* — Oliff PLC

(57) ABSTRACT

A kneaded sand property adjusting system including: a kneading device; a kneaded sand storage hopper that stores kneaded sand; a molding device that molds the sand conveyed from the sand storage hopper; a control device that controls water injection until a property of the sand meets a kneaded sand target property; and kneaded sand amount measuring instruments that measure the amount of sand stored in storage hopper, wherein the control device stores the batch number of each kneaded batch and the kneaded sand property measured at the time of kneading, calculates the batch number of the kneaded batch that corresponds to the molding sand being loaded into the molding device by the kneaded sand amount measuring instruments, associates the property of the molding sand with the property stored on by the batch number that was calculated, and corrects the target property on the basis of the values of the properties.

8 Claims, 4 Drawing Sheets

(51) Int. Cl.

| | |
|---|---|
| ***B22C 5/08*** | (2006.01) |
| ***B22C 5/16*** | (2006.01) |
| ***B22C 9/02*** | (2006.01) |
| ***B22C 19/04*** | (2006.01) |

(58) Field of Classification Search
USPC ..... 366/8, 17
See application file for complete search history.

(56) References Cited

U.S. PATENT DOCUMENTS 4,291,379 A * 9/1981 Cappelletto ..... B22C 5/00 700/271
4,304,289 A * 12/1981 McMullen ..... G05D 22/02 164/154.4
4,569,025 A * 2/1986 Eirich ..... B22C 5/00 366/132
4,915,160 A * 4/1990 Reynolds ..... B22C 5/0472 164/155.3
5,054,538 A * 10/1991 Ibsen ..... B22D 47/02 164/154.1
5,386,868 A * 2/1995 Kingman ..... B22C 1/00 164/154.6
5,505,247 A * 4/1996 Musschoot ..... B22D 29/00 164/131
5,697,424 A * 12/1997 Ferdinandsen ..... B22D 47/02 164/154.1
10,144,054 B2 * 12/2018 Ogura ..... B22C 5/18
10,512,968 B2 * 12/2019 Ogura ..... B22C 9/02
2015/0114259 A1 * 4/2015 Ogura ..... B28C 7/0409 106/286.5

FOREIGN PATENT DOCUMENTS

JP 2000-005841 A 1/2000
JP 2001-321892 A 11/2001
JP 2004-130329 A 4/2004
JP 4129728 B2 8/2008
JP 2009-166097 A 7/2009
JP 6086819 B2 11/2012

* cited by examiner

[FIG. 1]
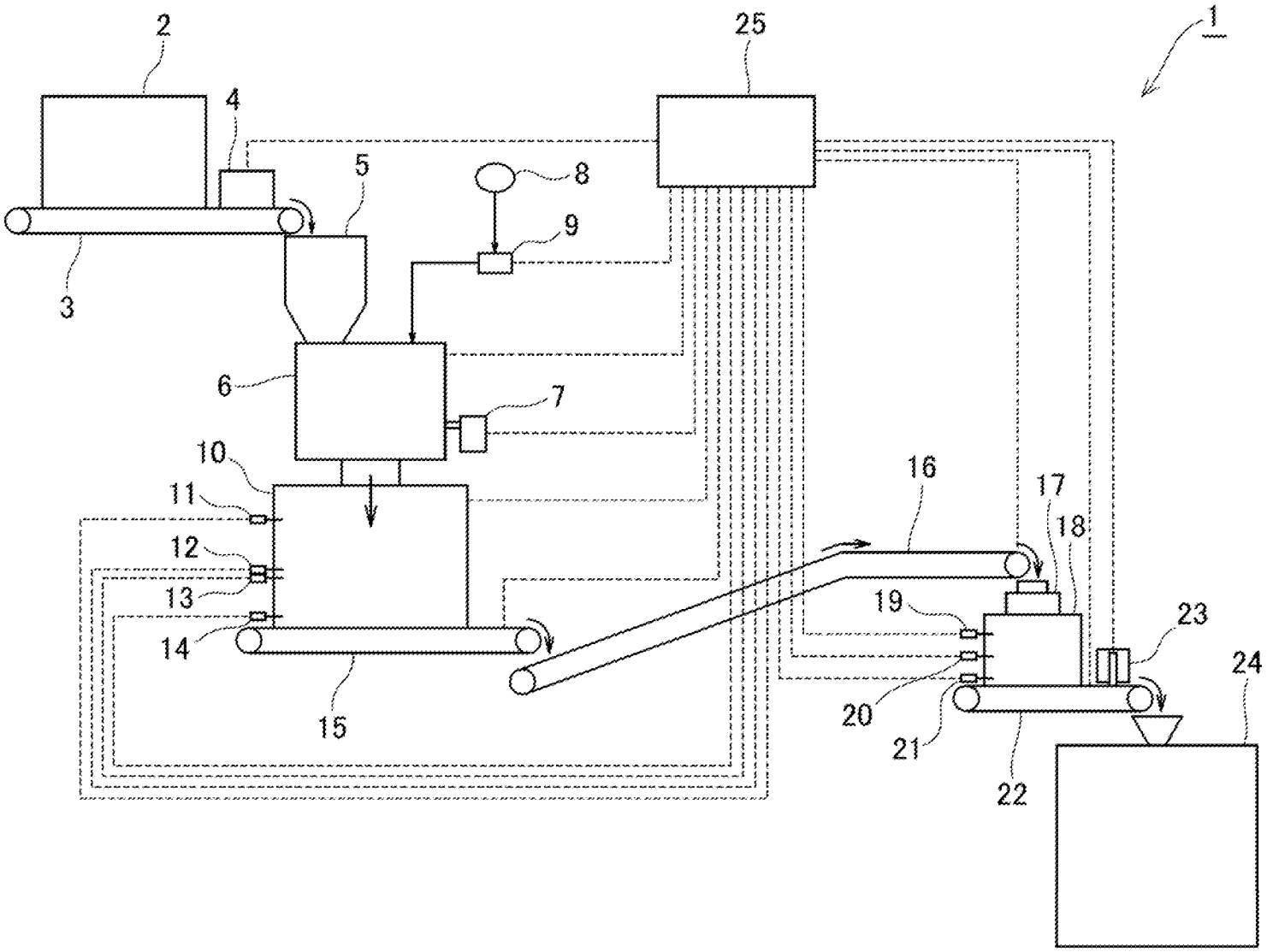

[FIG. 2]
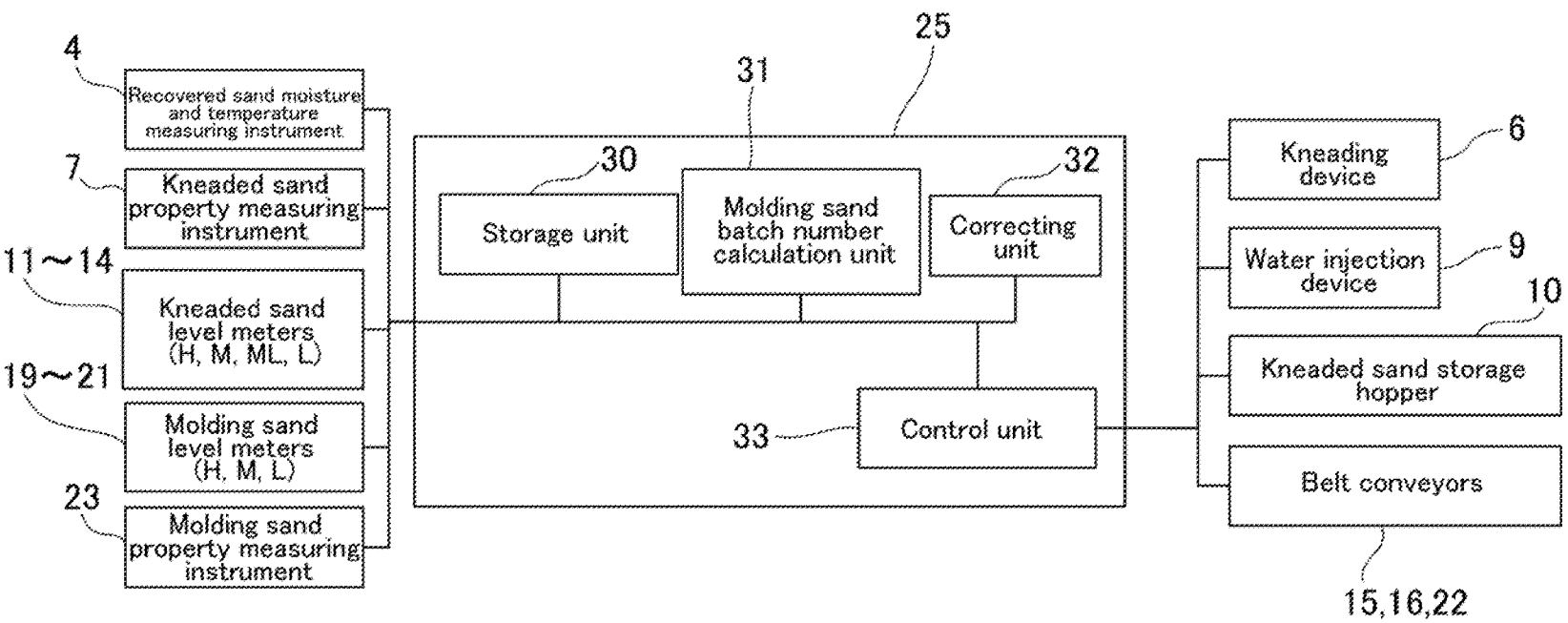

[FIG. 3]
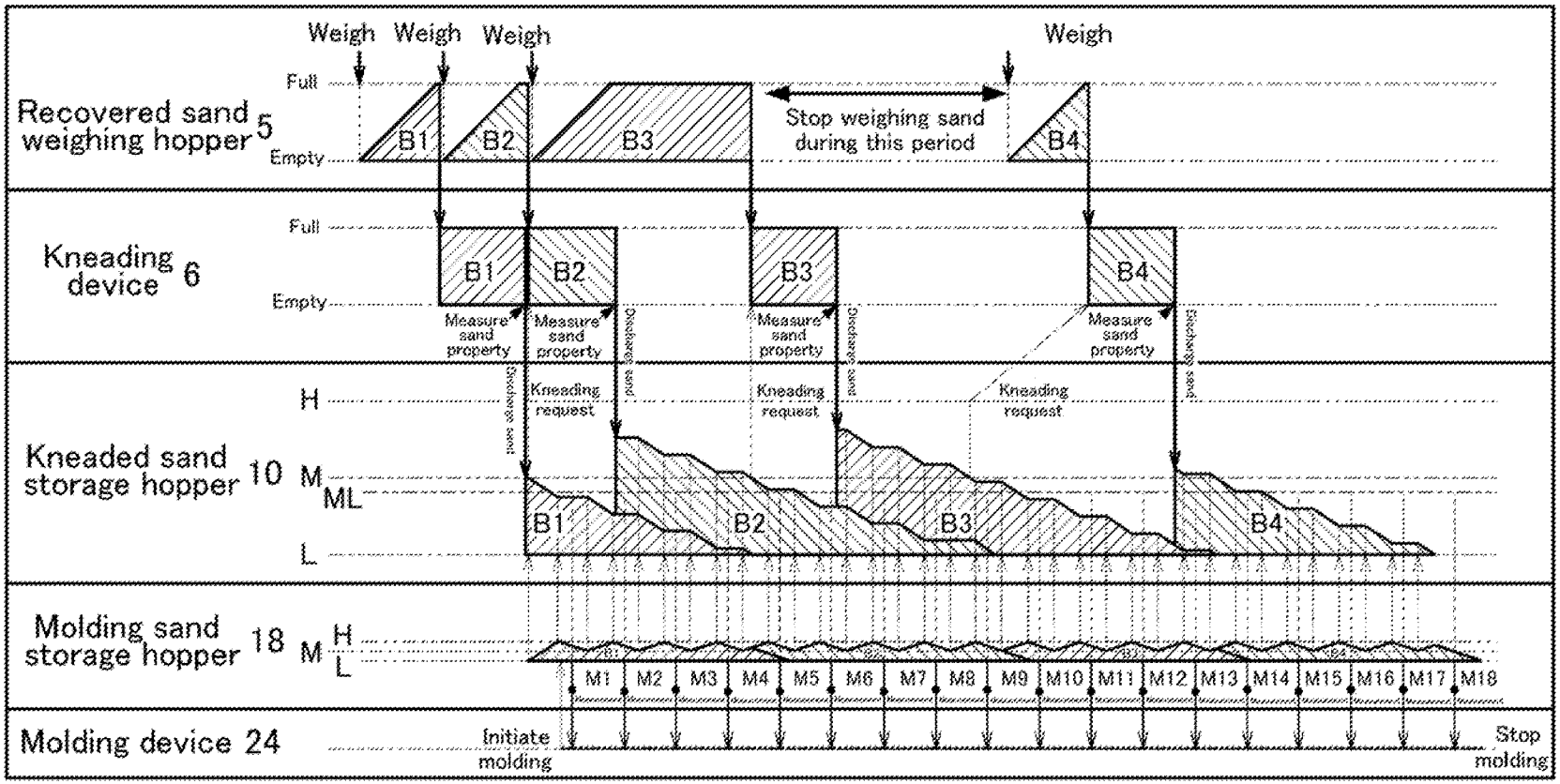

[FIG. 4]
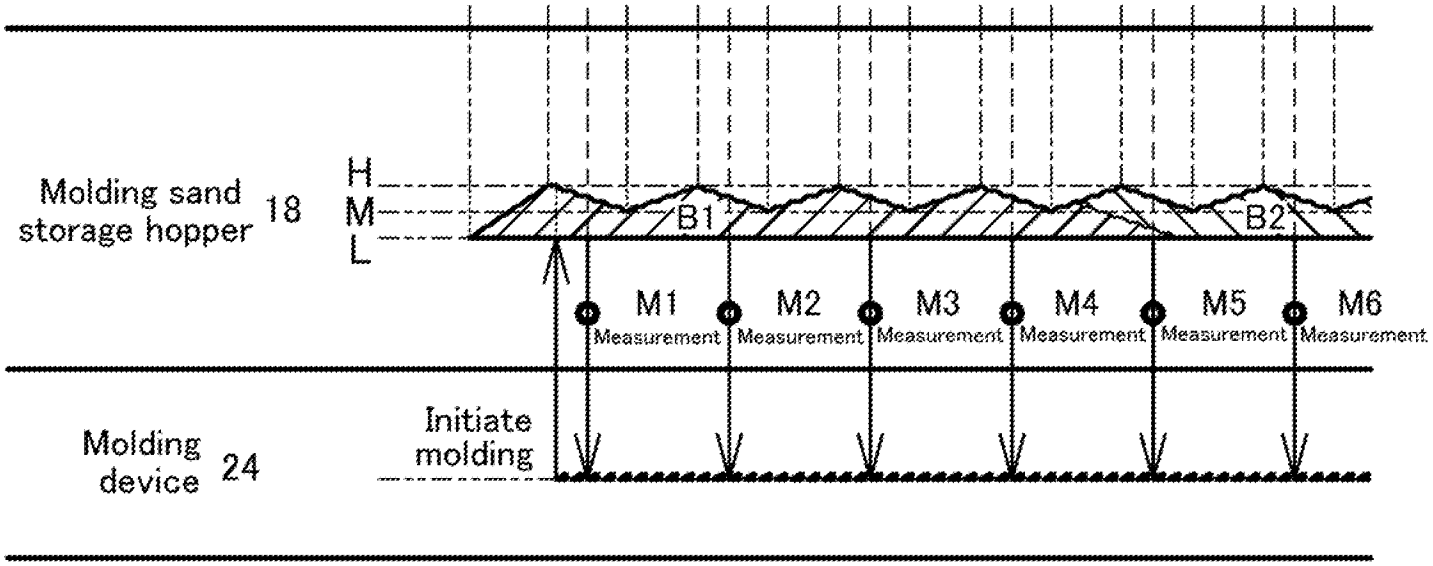

PROPERTY ADJUSTING SYSTEM AND PROPERTY ADJUSTING METHOD FOR KNEADED SAND

TECHNICAL FIELD

The present invention relates to a kneaded sand property adjusting system and property adjusting method.

BACKGROUND

As seen in prior art, sand casting, which is a casting method that uses sand as molds, is widely practiced. In sand casting, molten metal cast in a sand mold solidifies and then the casting is shaken out, separating the sand used as the mold from the casting. The separated sand is recovered as recovered sand, subjected to foreign matter removal as well as sand cooling, kneaded and adjusted, and then reused for molding sand molds.

Green sand molds are mainly kneaded and adjusted by batch kneading machines, particularly in green sand mold molding. Additives such as bentonite that were added to green sand are consumed by pouring a high-temperature melt into a mold and bringing green sand into contact with the melt. In a kneading machine, consumed additives are replenished, water is added, and the sand is kneaded and adjusted so as to be green sand that is suitable for molding. Compactability (hereinafter referred to as "CB") values or sand moisture values are often used as indicators for green sand that is suitable for molding. CB controllers, moisture controllers and the like are used for the measurement and control of such indicators.

Kneaded sand that has been kneaded and adjusted using such controllers is conveyed to a molding machine. If the kneading machine and the molding machine are placed apart, kneaded sand discharged from the kneading machine is conveyed by a belt conveyor, stored inside a hopper, and then supplied as molding sand from the hopper to the molding machine. During such times as when kneaded sand is being conveyed and molding sand is being stored, the properties of green sand change due to the evaporation of moisture and the passing of time.

To deal with such property changes, Patent Document 1 discloses a method for setting kneading target CB values in accordance with the temperature of sand loaded into a kneading machine.

In addition, Patent Document 2 discloses a sand property stabilization method as follows. First, the sand property measurement time and the sand property measured value at the time of discharge by a kneading machine, as well as the sand property measurement time and the sand property measured value before a molding machine, are measured and recorded. Next, from the previous sand property measurement time before the molding machine and the sand transportation time from the kneading machine to the molding machine, the kneading time of the sand corresponding thereto is calculated, and then the sand property measured value at the time of discharge by the kneading machine at the calculated kneading time is retrieved and read out. The amount of change in the sand property measured value due to the transportation route of sand is calculated from the sand property measured value at the time of discharge by the kneading machine at the calculated kneading time and the previous sand property measured value before the molding machine. The kneading machine is controlled on the basis of the amount of change.

[Patent Document 1] JP 2000-5841 A
[Patent Document 2] JP 4129728 B

SUMMARY OF INVENTION

Technical Problem

Patent Document 1 does not disclose, for example, measuring a property of the molding sand in the process in which the kneaded sand is conveyed from the kneading machine up to the molding machine, such as before the molding machine. In other words, because the actual change in a property of the kneaded sand in the process from the kneading machine to the molding machine is not measured in the method described in Patent Document 1, the kneading target CB value cannot be accurately set. Thus, kneading control cannot be accurately performed.

In the method described in Patent Document 2, the sand transportation time is a constant, fixed value. Thus, if for example a problem occurs in the kneading system and the system temporarily stops, resulting in a case in which kneaded sand has not been conveyed from the kneading machine to the molding machine within an assumed time, the kneading time for the corresponding sand would not be appropriately calculated. Consequently, the sand property measured value before the molding machine and the sand property measured value at the time of discharge by the kneading machine would not correctly correspond to each other. In other words, in such cases, it would not be possible to accurately calculate the amount of change in a sand property measured value due to the sand transportation path. Thus, kneading control cannot be accurately performed.

The problem to be solved by the present invention is to provide a kneaded sand property adjusting system and property adjusting method capable of accurate kneading control.

Solution to Problem

The kneaded sand property adjusting system according to the present invention comprises: a batch kneading device; a kneaded sand property measuring instrument that measures a property of the kneaded sand being kneaded; a water injection device that injects water into the kneading device; a kneaded sand storage hopper that stores the kneaded sand discharged from the kneading device; a molding device that performs molding using the kneaded sand discharged from and conveyed from the kneaded sand storage hopper as molding sand; a control device that controls water injection by controlling the water injection device until the property of the kneaded sand in the kneading device meets a kneaded sand target property; a kneaded sand amount measuring instrument that measures the amount of the kneaded sand stored in the kneaded sand storage hopper; and a molding sand property measuring instrument that measures the property of the molding sand to be loaded into the molding device, wherein the control device comprises: a storage unit that stores the batch number of each kneaded batch and the kneaded sand property measured by the kneaded sand property measuring instrument in each kneaded batch in association with each other; a molding sand batch number calculation unit that calculates the batch number of the kneaded batch that corresponds to the molding sand whose property is being measured by the molding sand property measuring instrument on the basis of the amount of the kneaded sand measured by the kneaded sand amount measuring instrument; and a correcting unit that associates the molding sand property measured by the molding sand property measuring instrument with the kneaded sand property stored in the storage unit on the basis of the batch number that was calculated and corrects the kneaded sand target property on the basis of the values of the properties.

In addition, the kneaded sand property adjusting method according to the present invention comprises: kneading the kneaded sand in a batch kneading device by means of the kneading device while injecting water into the kneading device until a property of the kneaded sand in the kneading device meets a kneaded sand target property; measuring the property of the kneaded sand that was kneaded and storing the batch number of the kneaded batch and the kneaded sand property that was measured in association with each other; storing the kneaded sand discharged from the kneading device in a kneaded sand storage hopper; performing molding with the molding device using the kneaded sand discharged from and conveyed from the kneaded sand storage hopper as molding sand; measuring the property of the molding sand to be loaded into the molding device; measuring the amount of the kneaded sand stored in the kneaded sand storage hopper; calculating the batch number of the kneaded batch that corresponds to the molding sand whose property is being measured on the basis of the amount of the kneaded sand that was measured; and associating the property of the molding sand that was measured with the kneaded sand property that was stored on the basis of the batch number that was calculated and correcting the kneaded sand target property on the basis of the values of the properties.

Advantageous Effects of Invention

According to the present invention, it is possible to provide a kneaded sand property adjusting system and property adjusting method capable of accurate kneading control.

BRIEF DESCRIPTION OF DRAWINGS

FIG. 1 is a schematic configuration view of a kneaded sand property adjusting system shown as an embodiment of the present invention.

FIG. 2 is a block diagram of a control device in the kneaded sand property adjusting system shown as an embodiment of the present invention.

FIG. 3 is an explanatory view of a kneaded sand property adjusting method shown as an embodiment of the present invention.

FIG. 4 is an enlarged view of FIG. 3.

DESCRIPTION OF EMBODIMENTS

An embodiment of the present invention is described in detail below with reference to the drawings.

FIG. 1 is a schematic configuration view of a kneaded sand property adjusting system 1 shown as an embodiment of the present invention. In sand casting, molten metal cast in a sand mold solidifies, and then the sand used as the mold is separated from the casting and recovered as recovered sand. The recovered sand is subjected to foreign matter removal as well as sand cooling and then kneaded and adjusted, thus allowing kneaded sand to be obtained. The kneaded sand is conveyed to a molding device, and then reused as molding sand for molding a sand mold. In this series of reclamation steps, the kneaded sand property adjusting system 1 particularly kneads green sand mold-recovered sand in green sand mold molding, and adjusts a property of the kneaded sand.

The kneaded sand property adjusting system 1 comprises: a batch kneading device 6; a kneaded sand property measuring instrument 7 that measures a property of the kneaded sand being kneaded; a water injection device 9 that injects water into the kneading device 6; a kneaded sand storage hopper 10 that stores the kneaded sand discharged from the kneading device 6; a molding device 24 that performs molding using the kneaded sand discharged from and conveyed from the kneaded sand storage hopper 10 as molding sand; a control device 25 that controls water injection by controlling the water injection device 9 until the property of the kneaded sand in the kneading device 6 meets a kneaded sand target property; kneaded sand amount measuring instruments 11, 12, 13, 14 that measure the amount of kneaded sand stored in the kneaded sand storage hopper 10; and a molding sand property measuring instrument 23 that measures the property of the molding sand to be loaded into the molding device 24.

The kneaded sand property adjusting system 1 further comprises: a molding sand storage hopper 18 that stores molding sand to be loaded into the molding device 24; molding sand amount measuring instruments 19, 20, 21 that measure the amount of molding sand stored in the molding sand storage hopper 18; and a sand temperature measuring instrument 4 that measures the temperature of sand before the sand is loaded into the kneading device 6.

Green sand properties generally refer to moisture, CB, compressive strength, permeability, temperature and the like. Moldability is most significantly affected by CB or moisture. However, because CB changes even when the moisture is the same, as described later in more detail, the property used for control in the kneaded sand property adjusting system 1 is the CB value in the present embodiment.

The kneaded sand property adjusting system 1 will be described in detail below. The kneaded sand property adjusting system 1 comprises a recovered sand hopper 2 and a belt feeder 3. Recovered sand that has been separated from a casting and subjected to foreign matter removal as well as sand cooling is stored in the recovered sand hopper 2. The belt feeder 3 is provided below the recovered sand hopper 2. A constant amount of recovered sand stored in the recovered sand hopper 2 is weighed, cut out, and then discharged to the belt feeder 3 from a recovered sand discharge port (not shown) provided in the recovered sand hopper 2. Recovered sand discharged to the belt feeder 3 is conveyed to a recovered sand weighing hopper 5, which will be described later in more detail.

In the present embodiment, the sand temperature measuring instrument 4 is a recovered sand moisture and temperature measuring instrument 4. The recovered sand moisture and temperature measuring instrument 4 is provided on the belt feeder 3. The moisture content and the temperature of recovered sand conveyed on the belt feeder 3 is measured by the recovered sand moisture and temperature measuring instrument 4. A control device 25, which will be described later in more detail, is electrically connected to the recovered sand moisture and temperature measuring instrument 4. The moisture content and the temperature measured by the recovered sand moisture and temperature measuring instrument 4 are transmitted to the control device 25.

The kneaded sand property adjusting system 1 comprises a recovered sand weighing hopper 5. Recovered sand conveyed by the belt feeder 3 is supplied to and stored in the recovered sand weighing hopper 5. When the recovered sand weighing hopper 5 is full, the recovered sand weighing hopper 5 discharges the recovered sand stored therein as one kneaded batch from a discharge port (not shown) to the kneading device 6 provided beneath the recovered sand weighing hopper 5.

The kneading device 6 receives recovered sand for one kneaded batch, which is discharged by the recovered sand weighing hopper 5, through an opening (not shown) provided at the upper portion of the kneading device 6 and kneads the recovered sand to generate kneaded sand. The kneaded sand property adjusting system 1 comprises a water source 8. The water source 8 is connected to the kneading device 6 through the water injection device 9. When initiating kneading in the kneading device 6, water supplied from the water source 8 is injected into the kneading device 6. In the present embodiment, the water injection device 9 is a water injection valve. The control device 25, which will be described later in more detail, is electrically connected to the water injection device 9. The water injection device 9 is controlled by the control device 25 such that the amount of water supplied from the water source 8 to the kneading device 6 is an appropriate amount of water calculated by the control device 25.

The kneaded sand property measuring instrument 7 is attached to a side of the kneading device 6. After kneading has been initiated in the kneading device 6 and a prescribed amount of time has passed, the kneaded sand property measuring instrument 7 collects samples of kneaded sand being kneaded and measures the property of the kneaded sand. The control device 25, which will be described later in more detail, is electrically connected to the kneaded sand property measuring instrument 7. The property of the kneaded sand measured by the kneaded sand property measuring instrument 7 is transmitted to the control device 25.

As described later in more detail, the kneading device 6 and the water injection device 9 are controlled by the control device 25 such that water injection, property measurement, and kneading are repeated until the property of the kneaded sand measured by the kneaded sand property measuring instrument 7 reaches the kneaded sand target property managed by the control device 25. Consequently, the kneading device 6 continues kneading until the kneaded sand meets the kneaded sand target property managed by the control device 25. When the property of the sand being kneaded reaches the kneaded sand target property, the kneaded sand property measuring instrument 7 transmits the measured value at that time to the control device 25. Thereafter, the kneaded sand for which kneading has finished is discharged from a discharge port (not shown) provided underneath the kneading device 6 to the kneaded sand storage hopper 10, which is provided underneath the kneading device 6.

If the amount of kneaded sand stored in the kneaded sand storage hopper 10, which will be described later in more detail, does not meet an amount for one kneaded batch, that is, if the upper surface of kneaded sand that is stored is at a position that is lower than a kneaded sand level meter M 12, which will be described later in more detail, the kneading device 6 is controlled by the control device 25 so as to receive a kneading request from the control device 25, receive recovered sand for one kneaded batch from the recovered sand weighing hopper 5 and knead the recovered sand, and then discharge kneaded sand to the kneaded sand storage hopper 10.

The kneaded sand storage hopper 10 receives kneaded sand for which kneading has finished through an opening (not shown) provided at the upper portion of the kneaded sand storage hopper 10, and stores the kneaded sand. The kneaded sand property adjusting system 1 comprises belt conveyors 15, 16. If molding sand housed in the molding sand storage hopper 18, which will be described later in more detail, is less than half of the molding sand storage hopper 18, that is, if the upper surface of the molding sand is at a position that is lower than a molding sand level meter M 20, which will be described later in more detail, the kneaded sand storage hopper 10 and the belt conveyors 15, 16 are controlled by the control device 25 such that the kneaded sand storage hopper 10 discharges a constant amount of kneaded sand from a kneaded sand supply port (not shown) onto the belt conveyor 15 and the belt conveyor 15 conveys the kneaded sand that was discharged. Kneaded sand conveyed by the belt conveyor 15 is further conveyed by the belt conveyor 16.

The amount of kneaded sand stored in the kneaded sand storage hopper 10 changes moment to moment due to the receiving of kneaded sand from the kneading device 6 and the discharging of kneaded sand to the belt conveyor 15. The kneaded sand amount measuring instruments 11, 12, 13, 14 measure the amount of kneaded sand stored in the kneaded sand storage hopper 10. In other words, the kneaded sand amount measuring instruments 11, 12, 13, 14 are level meters that measure the position of the upper surface of kneaded sand stored in the kneaded sand storage hopper 10.

More specifically, the kneaded sand amount measuring instruments 11, 12, 13, 14 comprise a kneaded sand level meter H 11, a kneaded sand level meter M 12, a kneaded sand level meter ML 13, and a kneaded sand level meter L 14. The kneaded sand level meters 11, 12, 13, 14 are each disposed at different heights on a side of the kneaded sand storage hopper 10. The level meters measure the amount of kneaded sand stored in the kneaded sand storage hopper 10 by detecting whether the upper surface of kneaded sand that is stored is at a position that is higher than the height position that corresponds to each of the kneaded sand level meters 11, 12, 13, 14.

The kneaded sand storage hopper 10 has a capacity that is capable of housing an amount of kneaded sand that corresponds to two kneaded batches. The kneaded sand level meter H 11 is provided at a height position where sand can be detected when kneaded sand suitable for two kneaded batches is housed in the kneaded sand storage hopper 10. The kneaded sand level meter M 12 is provided at a height position where sand can be detected when an amount of kneaded sand suitable for one kneaded batch is housed in the kneaded sand storage hopper 10. The kneaded sand level meter ML 13 is provided at a position where an amount of sand, which is less than an amount that corresponds to a molding sand level meter H 19 provided in the molding sand storage hopper 18, which will be described later in more detail, but which is greater than an amount that corresponds to a molding sand level meter M 20, is subtracted from the height position of the kneaded sand level meter M 12. The kneaded sand level meter L 14 is provided at a height position where it is possible to detect that the kneaded sand storage hopper 10 is empty.

The control device 25, which will be described later in more detail, is electrically connected to the kneaded sand level meters 11, 12, 13, 14. The amount of kneaded sand measured by each of the kneaded sand level meters 11, 12, 13, 14 is transmitted to the control device 25.

The kneaded sand property adjusting system 1 comprises a crushing device 17 underneath the termination of the belt conveyor 16. Kneaded sand stored in the kneaded sand storage hopper 10 is further conveyed by the belt conveyors 15, 16, as described above, and supplied to the crushing device 17. The crushing device 17 crushes sand lumps in supplied kneaded sand. Sand lumps in kneaded sand refer to kneaded sand that is compacted into approximately fist-size lumps while being kneaded or conveyed, and has sand properties similar to those of other kneaded sand. The crushing device 17 discharges crushed kneaded sand as molding sand from a discharge port (not shown) provided underneath the crushing device 17 to the kneaded sand storage hopper 18, which is provided underneath the crushing device 17.

The molding sand storage hopper 18 receives molding sand through an opening (not shown) provided at the upper portion of the molding sand storage hopper 18, and stores the molding sand. The kneaded sand property adjusting system 1 comprises a belt conveyor 22. Regarding the molding sand stored in the molding sand storage hopper 18, the amount of molding sand required for one molding is cut out at an appropriate interval from a molding sand discharge port (not shown) provided in the molding sand storage hopper 18, and supplied successively to the belt conveyor 22. If the amount of molding sand stored in the molding sand storage hopper 18 is greater than or equal to a molding sand level meter L 21, which will be described later in more detail, and there is a request for sand from the molding device 24, the belt conveyor 22 is controlled by the control device 25 so as to discharge sand to the molding device 24.

The amount of molding sand stored in the molding sand storage hopper 18 changes moment to moment due to the discharging of molding sand from the crushing device 17 and the supplying of molding sand to the belt conveyor 22. Molding sand amount measuring instruments 19, 20, 21 measure the amount of molding sand stored in the molding sand storage hopper 18. In other words, the molding sand amount measuring instruments 19, 20, 21 are level meters that measure the position of the upper surface of molding sand stored in the molding sand storage hopper 18.

More specifically, the molding sand amount measuring instruments 19, 20, 21 comprise a molding sand level meter H 19, a molding sand level meter M 20, and a molding sand level meter L 21. The molding sand level meters 19, 20, 21 are each disposed at different heights on a side of the molding sand storage hopper 18. The level meters measure the amount of molding sand stored in the molding sand storage hopper 18 by detecting whether the upper surface of molding sand that is stored is at a position that is higher than the height position that corresponds to each of the molding sand level meters 19, 20, 21.

The molding sand storage hopper 18 has a capacity that is capable of housing an amount of molding sand that corresponds to about one-fourth the amount for one kneaded batch. The molding sand level meter H 19 is provided at a height position where it is possible to detect sand when kneaded sand conveyed on the belt conveyor 15 is loaded into the molding sand storage hopper 18 and the molding sand storage hopper 18 becomes full. The molding sand level meter M 20 is provided at a height position where it is possible to detect sand when the amount of sand in the molding sand storage hopper 18 is half. The molding sand level meter L 21 is provided at a height position where it is possible to detect that the molding sand storage hopper 18 is empty.

The control device 25, which will be described later in more detail, is electrically connected to the molding sand level meters 19, 20, 21. The amount of molding sand measured by each of the molding sand level meters 19, 20, 21 is transmitted to the control device 25.

The molding sand property measuring instrument 23 is provided on the belt conveyor 22. The molding sand property measuring instrument 23 measures the property of molding sand to be loaded into the molding device 24, as described above. In the present embodiment, the molding sand property measuring instrument 23 particularly measures the property of molding sand at the point in time when molding sand is discharged from the molding sand storage hopper 18. In other words, the molding sand property measuring instrument 23 measures the property of molding sand conveyed on the belt conveyor 22. The control device 25, which will be described later in more detail, is electrically connected to the molding sand property measuring instrument 23. The property of the molding sand measured by the molding sand property measuring instrument 23 is transmitted to the control device 25.

The molding device 24 is provided underneath the termination of the belt conveyor 22. Molding sand stored in the molding sand storage hopper 18 is further conveyed by the belt conveyor 22, as described above, and supplied to the molding device 24. The molding device 24 performs molding using the supplied molding sand.

As described above, the moisture content and the temperature of recovered sand measured by the recovered sand moisture and temperature measuring instrument 4; the property of kneaded sand measured by the kneaded sand property measuring instrument 7; the amount of kneaded sand stored in the kneaded sand storage hopper 10 measured by each of the kneaded sand level meters 11, 12, 13, 14; the amount of molding sand stored in the molding sand storage hopper 18 measured by each of the molding sand level meters 19, 20, 21; and the property of molding sand measured by the molding sand property measuring instrument 23 are transmitted to the control device 25. The control device 25 receives the measured values and performs a computation, which will be explained later in more detail. Then, the control device 25 controls the water injection device 9, the kneading device 6, the kneaded sand storage hopper 10, and the belt conveyors 15, 16, 22 on the basis of the results of the computation.

FIG. 2 is a block diagram of the control device 25. The control device 25 comprises: a storage unit 30 that stores the batch number of each kneaded batch and the kneaded sand property measured by the kneaded sand property measuring instrument 7 in each kneaded batch in association with each other; a molding sand batch number calculation unit 31 that calculates the batch number of the kneaded batch that corresponds to the molding sand whose property is being measured by the molding sand property measuring instrument 23 on the basis of the amount of kneaded sand measured by the kneaded sand amount measuring instruments 11, 12, 13, 14; and a correcting unit 32 that associates the molding sand property measured by the molding sand property measuring instrument 23 with the kneaded sand property stored in the storage unit 30 on the basis of the batch number that was calculated and corrects the kneaded sand target property on the basis of the values of the properties.

The storage unit 30 counts the kneaded batch number internally by means of methods such as counting the number of times recovered sand was supplied from the recovered sand weighing hopper 5 to the kneading device 6. The kneaded sand property measuring instrument 7, at an appropriate time during kneading and when the property of kneaded sand being kneaded reaches the kneaded sand target property, transmits the measured value to the control device 25 as a kneaded sand property. The storage unit 30 retains the kneaded sand property, which was transmitted from the kneaded sand property measuring instrument 7 when the property of the kneaded sand being kneaded reached the kneaded sand target property, and the kneaded batch number in association with each other.

Furthermore, the storage unit 30 further stores the batch number of each kneaded batch and the temperature of each kneaded batch measured by a sand temperature measuring instrument, that is, the recovered sand moisture and temperature measuring instrument 4, in association with each other. The recovered sand moisture and temperature measuring instrument 4 measures the moisture content and the temperature a plurality of times for one kneaded batch, and sends the measurement results to the control device 25. The storage unit 30 calculates the average value of the moisture content and the average value of the temperature for the plurality of moisture contents and temperatures that correspond to the one kneaded batch. The storage unit 30 retains the average values, as the moisture content and the temperature that correspond to the one kneaded batch, and the kneaded batch number in association with each other.

Consequently, the storage unit 30 retains the kneaded batch number and the kneaded sand property in the kneaded batch number, and the moisture content and the temperature of the recovered sand that corresponds to the kneaded batch number in correspondence with each other. Further, the storage unit 30 retains the molding sand property measured by the molding sand property measuring instrument 23 and the kneaded batch number in association with each other on the basis of the kneaded batch number which is calculated by the molding sand batch number calculating unit 31 to be described next and which corresponds to the molding sand whose property was measured by the molding sand property measuring instrument 23.

The molding sand batch number calculating unit 31 calculates which of the kneaded batches stored in the storage unit 30 that the molding sand, discharged from the molding sand storage hopper 18 and positioned on the belt conveyor 22 and whose molding sand property is being measured by the molding sand property measuring instrument 23, corresponds to.

As described in the background of the present invention, the properties of sand change due to the evaporation of moisture and the passing of time. For this reason, the actual measured value at the point in time when the property of molding sand is measured by the molding sand property measuring instrument 23, that is, the molding sand property, is a value that is often different from the targeted property of the molding sand. In other words, differences occur between the two values. To correct the differences, there is a need to identify the property of the molding sand to be measured by the molding sand property measuring instrument 23 at the point in time when the molding sand to be measured has been kneaded by the kneading device 6, and determine the amount of change in the property. The amount of change in the property can be determined by the molding sand batch number calculating unit 31 calculating the kneaded batch number that corresponds to the molding sand whose molding sand property is being measured by the molding sand property measuring instrument 23.

The calculation of the kneaded batch number that corresponds to the molding sand in the molding sand batch number calculating unit 31 is performed on the basis of the amount of kneaded sand measured by the kneaded sand amount measuring instruments 11, 12, 13, 14, as described above.

First, the case in which the amount of sand in the kneaded sand storage hopper 10 is under the kneaded sand level meter ML 13 when the molding sand property is being measured by the molding sand property measuring instrument 23 will be described. As described above, the kneaded sand level meter M 12 is provided at a height position where sand can be detected when kneaded sand for one kneaded batch is housed in the kneaded sand storage hopper 10, and the kneaded sand level meter ML 13 is provided at a position that is slightly lower than the kneaded sand level meter M 12. In other words, the state in which the amount of sand in the kneaded sand storage hopper 10 is less than the kneaded sand level meter ML 13 is a state in which there is only a quantity of sand in the kneaded sand storage hopper 10 that is less than one kneaded batch as a result of, from a state in which there was sand for one kneaded batch temporarily inside the kneaded sand storage hopper 10, a portion of kneaded sand for the one kneaded batch being discharged through the belt conveyors 15, 16. Thus, molding sand positioned on the belt conveyors 15, 16, 22 whose property is currently being measured can be estimated to belong to the same kneaded batch as the kneaded sand currently stored in the kneaded sand storage hopper 10 and the molding sand to be supplied from the molding sand storage hopper 18 to the molding device 24, that is, the kneaded batch that was most recently discharged from the kneading device 6.

Next, the case in which the amount of sand in the kneaded sand storage hopper 10 is greater than or equal to the kneaded sand level meter ML 13 when the molding sand property is being measured by the molding sand property measuring instrument 23 will be described. As described later in more detail, if the upper surface of kneaded sand is at a position that is lower than the kneaded sand level meter M 12, the kneading device 6 is controlled by the control device 25 so as to knead the next kneaded batch and supply kneaded sand to the kneaded sand storage hopper 10. In other words, if the upper surface of kneaded sand is at a position that is higher than the kneaded sand level meter M 12 in the kneaded sand storage hopper 10, there is a mixture of: sand which belongs to a kneaded batch stored at the bottom side of the kneaded sand storage hopper 10 and which belongs to the same kneaded batch as the molding sand positioned on the belt conveyors 15, 16, 22 whose property is currently being measured and the molding sand to be supplied from the molding sand storage hopper 18 to the molding device 24; and sand which was newly kneaded after the kneaded batch and which belongs to a kneaded batch stored at the upper side of the kneaded sand storage hopper 10. Thus, in this case, it is possible to estimate that the sand kneaded one batch before the kneaded batch that was most recently discharged from the kneading device 6, that is, the kneaded batch stored at the upper side, belongs to the kneaded batch stored at the bottom side.

In practice, the determination of the case in which the amount of sand in the kneaded sand storage hopper 10 is greater than or equal to half of the kneaded sand storage hopper 10 is performed not using the kneaded sand level meter M 12, but rather the kneaded sand level meter ML 13 to determine whether the upper surface of kneaded sand is positioned above the kneaded sand level meter ML 13. The determination is made with consideration of the amount of sand that is stored until sand is loaded into the molding device 24 from the kneaded sand storage hopper 10.

As described above, the correcting unit 32 associates the molding sand property measured by the molding sand property measuring instrument 23 with the kneaded sand property stored in the storage unit 30 on the basis of the batch number calculated by the molding sand batch number calculating unit 31. In other words, the correcting unit 32, through the value of the kneaded batch number stored in the storage unit 30, comprehends the molding sand property of molding sand supplied to the molding device 24 and the kneaded sand property when the molding sand was being kneaded by the kneading device 6, and the moisture content and the temperature at the point in time when the molding sand is supplied to the recovered sand weighing hopper 5 in association with each other, and stores in the storage unit 30 the molding sand property and the associated kneaded batch number in association with each other.

Consequently, the amount of change in the property of the molding sand, whose molding sand property is being measured by the molding sand property measuring instrument 23, from when the molding sand was being kneaded in the kneading device 6 can be understood. The correcting unit 32 corrects the kneaded sand target property in the kneading device 6 on the basis of the amount of change. In other words, the correcting unit 32 calculates a correction factor by dividing the difference between the molding sand property and the kneaded sand property by the temperature associated with the calculated kneaded batch number, and then corrects the kneaded sand target property of the next kneaded batch to be kneaded on the basis of a value obtained by multiplying the correction factor by the temperature of sand of the next kneaded batch to be kneaded.

More specifically, the correcting unit 32 obtains the difference between the molding sand property and the kneaded sand property in correspondence with each other; divides the difference by the temperature measured by the recovered sand moisture and temperature measuring instrument 4, which is similarly in correspondence therewith; obtains as a change function the relationship between the temperature of recovered sand at the time of temperature measurement by the recovered sand moisture and temperature measuring instrument 4 and the amount of change until kneaded sand is molded, and then retains the change function. In the next kneading to be performed, a value obtained by multiplying the temperature of recovered sand measured by the recovered sand moisture and temperature measuring instrument 4 for the next kneaded batch by the change function is added to the molding sand target property as a correction factor, thus resulting in a new kneaded sand target property. Kneading is then performed on the basis of the new kneaded sand target property.

In this case, the temperature of recovered sand measured by the recovered sand moisture and temperature measuring instrument 4 is used for the calculation of the correction factor. This is based on the following reasons. As described above, examples of factors that change the sand properties of green sand from kneading to molding include the evaporation of moisture and the passing of time.

The evaporation of moisture is affected by the temperature of sand, the temperature and the humidity of the atmosphere, and the amount of time that has passed. In the conveyance process of kneaded sand, a lot of moisture evaporates on belt conveyors where kneaded sand is in increased contact with atmospheric air. Because the hopper that stores kneaded sand has a substantially sealed structure and the humidity of air in the hopper is close to 100%, there is little moisture evaporation in the hopper. The evaporation of moisture on belt conveyors is affected more significantly by the temperature of sand than the temperature and the humidity of the atmosphere. The evaporation of moisture will decrease the moisture content of bentonite, which is a caking material of green sand, and thus decrease the caking power of bentonite. If the caking power of bentonite decreases, the binding force of sand grains will also decrease, which will cause mold cracks in molds, sand inclusion due to sand being mixed into the melt and the like. Changes in the temperature of kneaded sand largely depend on the temperature of recovered sand loaded into the kneading machine, but do not depend as much on kneading.

In addition, regarding changes due to the passing of time, in the case of green sand that has been kneaded with water added thereto, even if the moisture content does not change over time, the CB value decreases and compressive strength increases, which is widely known as the "aging" effect. This change is known to become more significant the higher the addition rate of moisture during kneading. The addition rate of moisture during kneading is high because the moisture of recovered sand to be loaded into the kneading machine is low. The moisture of recovered sand is low because the temperature of recovered sand is high and much of the moisture evaporates before recovered sand reaches the kneading machine. In this case, the temperature of recovered sand that has reached the kneading machine tends to be high.

As described above, the temperature of recovered sand has significant effects on the two factors that change the properties of sand. Thus, in the present embodiment, a correction factor is used in which the temperature of recovered sand is reflected by dividing the difference between the molding sand property and the kneaded sand property by the temperature of recovered sand loaded into the kneading machine.

More specifically, the correcting unit 32 calculates a moving average of a value obtained by dividing the difference by the temperature associated with the kneaded batch number that was calculated and uses the moving average as a correction factor. Thus, in the present embodiment, the value that is obtained by calculating the moving average of a value, which is obtained by dividing the difference between the molding sand property and the kneaded sand property by the temperature of recovered sand, is actually used as the correction factor. In the present embodiment, particularly because the kneading machine is a batch type, the measurement of the property of molding sand by the molding sand property measuring instrument 23 is performed a plurality of times for one kneaded batch. Thus, the time from when the property of kneaded sand is measured to when the property of molding sand is measured would be different even for one kneaded batch. Because the degree of change in sand properties also differs over time from kneading to molding, as described above, a moving average of the correction factor is obtained to reduce the effects from the passing of time.

The number of data used for the calculation of the moving average is preferably that of a kneading batch number of around 3-20 times. For example, in the case of an amount equivalent to one kneaded batch, the number of data would be 12-80 pieces of data if the molding sand property is measured four times. If the kneaded batch number of data used for the calculation of the moving average is less than 3 times, there would be greater effects from unusual sand properties, such as sand that was adhered for a long duration dropping and becoming mixed in, and accurate correction would not be possible. In addition, if the kneaded batch number of data used for the calculation of the moving average is greater than 20 times, then following the sand property that fluctuates due to changes in the amount of the casting melt and the amount of core used and the like would be delayed and accurate correction would not be possible.

Corresponding to the calculation of the moving average of the correction factor, the change function also leaves a history within a range that corresponds to the calculation of the moving average of the correction factor and the history is used. For example, the 81st values and the like of old correction factors and change functions exceeding the upper limit of usage are discarded because such values are not used.

In the present embodiment, when initiating kneading of a given kneaded batch in the kneading device 6, the kneaded sand target property is calculated by only using the data before kneading initiation of the kneaded batch. The kneaded sand target property of the kneaded batch currently being kneaded is not updated during the kneading thereof, even if measurement data pertaining to a new molding sand property are transmitted to the control device 25. The new measurement data are used for the first time in the calculation of the kneaded sand target property for the next kneaded batch. In addition, immediately after the kneaded sand property adjusting system 1 is activated, the kneaded sand target property is calculated by using updated data within the range described above from among the data stored at the time of activation of the kneaded sand property adjusting system 1, that is, the last time the system was stopped.

The control device 25 comprises a control unit 33. The control unit 33 controls the water injection device 9, the kneading device 6, the kneaded sand storage hopper 10, and the belt conveyors 15, 16, 22. The control device 25 performs mainly two kinds of control: water injection control for the kneading device 6, and conveyance control for sand throughout the entirety of the kneaded sand property adjusting system 1.

First, water injection control will be described. When kneading is initiated in the kneading device 6, the control unit 33 controls the water injection device 9 and the water injection device 9 injects water from the water source 8 into the kneading device 6. The amount of water to be injected for the kneaded batch to be kneaded at this time is derived by retrieving from the storage unit 30 the measured values of the moisture content and the temperature of recovered sand measured by the recovered sand moisture and temperature measuring instrument 4, and then calculating the amount of water needed for the sand to reach the targeted kneaded sand property.

In addition, after a prescribed amount of time has passed from kneading initiation in the kneading device 6, the kneaded sand property is measured by the kneaded sand property measuring instrument 7 and transmitted to the control device 25. If the measured value has not reached the kneaded sand target property calculated by the correcting unit 32, the control unit 33 computes the amount of water that needs to be injected for the target property to be reached and controls the water injection device 9 to perform additional water injection. Then, again after a prescribed amount of time has passed, the kneaded sand property is measured by the kneaded sand property measuring instrument 7. The control described above is repeated until the kneaded sand property reaches the target value.

Next, sand conveyance control will be described. If the amount of kneaded sand in the kneaded sand storage hopper 10 does not meet the kneaded sand level meter M 12 after the point in time when kneading in the kneading device 6 has finished and the discharging of kneaded sand to the kneaded sand storage hopper 10 has completed, the control unit 33 controls the kneading device 6 so as to knead the next batch.

In addition, the control unit 33 controls the belt conveyors 15, 16 as follows. When the height of the upper surface of kneaded sand is at a position that is greater than or equal to the kneaded sand level meter L 14 of the kneaded sand storage hopper 10, that is, in a state in which the kneaded sand storage hopper 10 is not empty and the upper surface of molding sand in the molding sand storage hopper 18 is at a position that is lower than the molding sand level meter M 20, the control unit 33 activates the belt conveyors 15, 16.

When kneaded sand is introduced into the molding sand storage hopper 18 by way of the crushing device 17 and stored in the molding sand storage hopper 18, and the height of the upper surface of molding sand in the molding sand storage hopper 18 reaches the molding sand level meter H 19, the control unit 33 stops the discharging of kneaded sand from the kneaded sand storage hopper 10. Because kneaded sand will not be supplied to the belt conveyors 15, 16 when the discharging of kneaded sand from the kneaded sand storage hopper 10 stops, the control unit 33 controls the belt conveyors 15, 16 so as to stop at the point in time when a prescribed amount of time has passed and the conveyance of kneaded sand on the belt conveyors 15, 16 has completed.

In addition, the control unit 33 controls the belt conveyor 22 as follows. When the upper surface of molding sand stored in the molding sand storage hopper 18 is greater than or equal to a molding sand level meter L 21, and there is a request for sand from the molding device 24, the control unit 33 controls the belt conveyor 22 so as to supply molding sand to the molding device 24.

The molding device 24 stops requesting for molding sand and performs molding when molding sand supplied through the belt conveyor 22 reaches an amount for one molding. When molding advances and the receiving of molding sand to be used for the next molding becomes possible, the molding device 24 will request for molding sand again. Thus, the control unit 33 operates the belt conveyor 22 again and controls the belt conveyor 22 so as to supply molding sand to the molding device 24.

When molding is repeatedly performed and the height of the upper surface of molding sand in the molding sand storage hopper 18 falls below the molding sand level meter M 20, the control unit 33 operates the belt conveyors 15, 16 and controls the belt conveyors 15, 16 so as to convey kneaded sand to the molding sand storage hopper 18, as described above.

Next, a method for adjusting the property of kneaded sand will be described using the kneaded sand property adjusting system 1.

The kneaded sand property adjusting method in the present embodiment comprises: kneading kneaded sand in a batch kneading device 6 by means of the kneading device 6 while injecting water into the kneading device 6 until a property of the kneaded sand in the kneading device 6 meets a kneaded sand target property; measuring the property of the kneaded sand that was kneaded and storing the batch number of the kneaded batch and the kneaded sand property that was measured in association with each other; storing the kneaded sand discharged from the kneading device 6 in a kneaded sand storage hopper 10; performing molding with the molding device 24 using the kneaded sand discharged from and conveyed from the kneaded sand storage hopper 10 as molding sand; measuring the property of the molding sand to be loaded into the molding device 24; measuring the amount of kneaded sand stored in the kneaded sand storage hopper 10; calculating the batch number of the kneaded batch that corresponds to the molding sand whose property is being measured on the basis of the amount of kneaded sand that was measured; and associating the property of the molding sand that was measured with the kneaded sand property that was stored on the basis of the batch number that was calculated and correcting the kneaded sand target property on the basis of the values of the properties. The present method will be described in detail below using FIG. 1-4.

FIG. 3 is an explanatory view of the kneaded sand property adjusting method. The present figure shows the transition of the amount of sand in the operation process of each device listed on the left side, as in the recovered sand weighing hopper 5, the kneading device 6, the kneaded sand storage hopper 10, the molding sand storage hopper 18, and the molding device 24. In FIG. 3, the horizontal axis represents the passage of time while the vertical axis represents the amount of stored sand. In FIG. 3, B1-B4 indicate kneaded batch numbers. B1 indicates sand that corresponds to the first kneaded batch number, and B2 indicates sand that corresponds to the second kneaded batch number. The same applies to B3 and B4. In addition, M1-M18 indicate measurement timings of the molding sand property in the molding sand property measuring instrument 23. M1 indicates the first measurement, and M2 indicates the second measurement. The same applies to M3 and the subsequent timings. FIG. 4 is an enlarged view of a portion pertaining to the molding sand storage hopper 18 and the molding device 24 immediately after the initiation of operation of the kneaded sand property adjusting system 1 in FIG. 3.

A constant amount of recovered sand stored in the recovered sand hopper 2 is weighed, cut out, and then supplied to the belt feeder 3. The recovered sand moisture and temperature measuring instrument 4 measures the moisture content and the temperature of recovered sand supplied to the belt feeder 3. The belt feeder 3 conveys recovered sand to the recovered sand weighing hopper 5. The recovered sand weighing hopper 5 weighs an amount of recovered sand that corresponds to one kneaded batch for the kneading device 6, and when the recovered sand weighing hopper 5 is full, the recovered sand weighing hopper 5 stops the belt feeder 3 and stops the cutting out of recovered sand from the recovered sand hopper 2. The present step corresponds to the part in FIG. 3 where the amount of sand is gradually increasing for kneaded batches B1-B4 in the recovered sand weighing hopper 5.

The recovered sand moisture and temperature measuring instrument 4 transmits the measured moisture content and temperature of recovered sand to the control device 25 a plurality of times for one kneaded batch. The storage unit 30 of the control device 25 stores the kneaded batch number counted therein and the average values of each of the plurality of moisture contents and temperatures that correspond to the kneaded batch number in association with each other. Further, the storage unit 30 retains the kneaded sand property measured by the kneaded sand property measuring instrument 7 that corresponds to the batch number and the molding sand property measured by the molding sand property measuring instrument 23 that corresponds to the batch number in association with the kneaded batch number, as described later in more detail.

When the recovered sand weighing hopper 5 is full, the recovered sand weighing hopper 5 maintains the state of being full, and if the amount of sand in the kneaded sand storage hopper 10 is less than the kneaded sand level meter M 12, the recovered sand weighing hopper 5 supplies the recovered sand that is stored to the kneading device 6 as one kneaded batch in accordance with a request from the kneading device 6. The present step corresponds to the part in FIG. 3 where, at three timings when the amount of sand in the kneaded sand storage hopper 10 is lower than the kneaded sand level meter M 12, the control unit 33 transmits a kneading request to the kneading device 6, and the kneading of kneaded batches B2, B3, B4 is accordingly initiated.

When the recovered sand weighing hopper 5 is empty, the recovered sand weighing hopper 5 weighs recovered sand for the next kneaded batch if the kneading device 6 is set to continuously knead. The recovered sand moisture and temperature measuring instrument 4 measures sand for the next kneaded batch, and transmits the results to the control device 25. The present step corresponds to the part in FIG. 3 where each of the kneaded batches B1-B4 stored in the recovered sand weighing hopper 5 is being conveyed to the kneading device 6; and the part where, for example, the kneaded batch B2 is being loaded into the recovered sand weighing hopper 5, which is empty after the kneaded batch B1 was conveyed, and the amount of sand is gradually increasing again.

Next, the molding sand batch number calculating unit 31 of the control device 25 calculates the kneaded batch number that corresponds to the molding sand whose molding sand property is currently being measured by the molding sand property measuring instrument 23, and then the correcting unit 32 calculates the correction factor on the basis of the results of the calculation and formulates the kneaded sand target property. In the case of the kneaded batches B1, B2 in FIG. 3, the kneaded sand property adjusting system 1 was just activated and currently the measurement by the molding sand property measuring instrument 23 had never been performed at the point in time of kneading initiation of the kneaded batches B1, B2. Thus, data stored at the time of activation of the kneaded sand property adjusting system 1, that is, the last time the system was stopped, are used to calculate the kneaded sand target property. Here, the case of the kneaded batches B3, B4 in which the measurement of the molding sand property by the molding sand property measuring instrument 23 is performed before kneading initiation and the molding sand property is used for the calculation of the kneaded sand target property will be discussed.

As described above, if the amount of sand in the kneaded sand storage hopper 10 is under the kneaded sand level meter ML 13 when the molding sand property is being measured by the molding sand property measuring instrument 23, the molding sand batch number calculating unit 31 estimates that the kneaded batch is the kneaded batch that was most recently discharged from the kneading device 6. In addition, if the amount of sand in the kneaded sand storage hopper 10 is greater than or equal to the kneaded sand level meter ML 13 when the molding sand property is being measured by the molding sand property measuring instrument 23, the molding sand batch number calculating unit 31 estimates that the kneaded batch is the kneaded batch that was kneaded one batch before the kneaded batch that was most recently discharged from the kneading device 6.

First, regarding M1, because the position of the upper surface of kneaded sand in the kneaded sand storage hopper 10 is lower than the kneaded sand level meter ML 13 at the point in time of measurement at M1, the molding sand batch number calculating unit 31 estimates that the molding sand being measured at M1 is the kneaded batch that was most recently discharged from the kneading device 6, that is, the kneaded batch B1. Regarding M2-M5, because the position of the upper surface of kneaded sand in the kneaded sand storage hopper 10 is higher than the kneaded sand level meter ML 13 at the point in time of measurements at M2-M5, the molding sand batch number calculating unit 31 estimates that the molding sand being measured at M2-M5 is the kneaded batch that was kneaded one batch before the kneaded batch B2, which was most recently discharged from the kneading device 6. In other words, the molding sand batch number calculating unit 31 estimates that the molding sand being measured is the kneaded batch B1.

Regarding M6, because the position of the upper surface of kneaded sand in the kneaded sand storage hopper 10 is lower than the kneaded sand level meter ML 13 at the point in time of measurement at M6, the molding sand batch number calculating unit 31 estimates that the molding sand being measured at M6 is the kneaded batch that was most recently discharged from the kneading device 6, that is, the kneaded batch B2.

Subsequently, in a similar manner, the molding sand batch number calculating unit 31 accordingly estimates that the molding sand at M7-M9 corresponds to the kneaded batch B2, the molding sand at M10-M13 corresponds to the kneaded batch B3, and the molding sand at M14-M18 corresponds to the kneaded batch B4, at the point in time when each of the measured values at M1-M18 is transmitted to the molding sand batch number calculating unit 31.

Thereafter, the correcting unit 32 associates the molding sand property measured by the molding sand property measuring instrument 23 with the kneaded sand property stored in the storage unit 30 on the basis of the batch number calculated by the molding sand batch number calculating unit 31. In other words, the correcting unit 32, through the value of the kneaded batch number stored in the storage unit 30, comprehends the molding sand property of molding sand supplied to the molding device 24 and the kneaded sand property when the molding sand was being kneaded by the kneading device 6, and the moisture content and the temperature at the point in time when the molding sand is supplied to the recovered sand weighing hopper 5 in association with each other, and stores in the storage unit 30 the molding sand property and the kneaded batch number corresponding thereto in association with each other. The correcting unit 32 further calculates a correction factor by dividing the difference between the molding sand property and the kneaded sand property by the temperature associated with the kneaded batch number that was calculated, and then corrects the kneaded sand target property of the next kneaded batch to be kneaded on the basis of a value obtained by multiplying the correction factor by the temperature of sand of the next kneaded batch to be kneaded.

More specifically, the correcting unit 32 obtains the difference between the molding sand property and the kneaded sand property in correspondence with each other; divides the difference by the temperature measured by the recovered sand moisture and temperature measuring instrument 4 similarly in correspondence therewith; obtains as a change function the relationship between the temperature of the recovered sand at the time of temperature measurement by the recovered sand moisture and temperature measuring instrument 4 and the amount of change until kneaded sand is molded, and then retains the change function. In the next kneading to be performed, a value obtained by multiplying the temperature of recovered sand measured by the recovered sand moisture and temperature measuring instrument 4 for the kneaded batch by the change function is added to the molding sand target property as a correction factor, thus resulting in a new kneaded sand target property. Kneading is then performed on the basis of the new kneaded sand target property.

More specifically, the correcting unit 32 calculates a moving average of the value obtained by dividing the difference by the temperature associated with the calculated kneaded batch number and uses the moving average as a correction factor. Thus, in the present embodiment, the value, which is obtained by calculating a moving average of a value obtained by dividing the difference between the molding sand property and the kneaded sand property by the temperature of recovered sand, is actually used as a correction factor.

For example, at the point in time when the kneading of the kneaded batch B3 is initiated, the molding sand property measuring instrument 23 transmits measurement results of the molding sand property to the control device 25 four times, as in M1-M4. Thus, the correcting unit 32 calculates a correction factor by retrieving, for each of the four molding sand properties, the corresponding kneaded sand property and temperature of recovered sand on the basis of the kneaded batch number calculated by the molding sand batch number calculating unit 31, and using each of the measurement results of M1-M4 after dividing the difference between the molding sand property and the kneaded sand property thereof by the temperature associated with the kneaded batch number that was calculated, together with the data stored when the kneaded sand property adjusting system 1 was last stopped, as needed, to calculate the moving average. The correction factor is added to the molding sand target property, thus allowing the kneaded sand target property of the kneaded batch B3 to be obtained.

In addition, for example, at the point in time when the kneading of the kneaded batch B4 is initiated, the molding sand property measuring instrument 23 transmits measurement results of the molding sand property to the control device 25 six times, as in M5-M10. Thus, the correcting unit 32 calculates the correction factor by retrieving, for each of the six molding sand properties, the corresponding kneaded sand property and temperature of recovered sand, and using each of the measurement results of M5-M10 after dividing the difference between the molding sand property and the kneaded sand property thereof by the temperature associated with the kneaded batch number that was calculated, together with the data stored when the kneaded sand property adjusting system 1 was last stopped as well as the results pertaining to M1-M4 that were used in the calculation of the kneaded sand target property of the kneaded batch B3, as needed, to calculate the moving average. The correction factor is added to the molding sand target property, thus allowing the kneaded sand target property of the kneaded batch B4 to be obtained.

As described above, the kneading device 6 performs kneading after the correcting unit 32 formulates the kneaded sand target property. When initiating kneading, the control unit 33 of the control device 25 controls the water injection device 9 and the water injection device 9 injects water from the water source 8 into the kneading device 6. The amount of water to be injected for the kneaded batch to be kneaded at this time is derived by retrieving from the storage unit 30 the measured values of the moisture content and the temperature of recovered sand measured by the recovered sand moisture and temperature measuring instrument 4, and then calculating the amount of water needed for the sand to reach the targeted kneaded sand property calculated by the correcting unit 32.

After a prescribed amount of time has passed from kneading initiation in the kneading device 6, the kneaded sand property measuring instrument 7 measures the kneaded sand property and transmits the measured kneaded sand property to the control device 25. If the measured value has not reached the kneaded sand target property calculated by the correcting unit 32, the control unit 33 computes the amount of water that needs to be injected for the target property to be reached and controls the water injection device 9 to perform additional water injection. Then, again after a prescribed amount of time has passed, the kneaded sand property is measured by the kneaded sand property measuring instrument 7. The control described above is repeated until the kneaded sand property reaches the target value.

When the kneaded sand property reaches the target value, the control unit 33 stops kneading in the kneading device 6. The storage unit 30 retains the property of the kneaded sand at the point in time when the kneaded sand property reached the target value and the kneaded batch number in association with each other. Thereafter, the kneading device 6 supplies the kneaded sand for which kneading has finished to the kneaded sand storage hopper 10. The present step corresponds to the part in FIG. 3 where each of the kneaded batches B1-B4 being kneaded in the kneading device 6 is being discharged to the kneaded sand storage hopper 10.

The kneaded sand storage hopper 10 stores the kneaded sand for which kneading has finished. As described above, the kneading device 6 has a capacity that is capable of housing an amount of kneaded sand that corresponds to two kneaded batches. Because the kneading device 6 receives recovered sand and performs kneading if the amount of kneaded sand in the kneaded sand storage hopper 10 is less than the kneaded sand level meter M 12, kneaded sand that exceeds the capacity of the kneaded sand storage hopper 10 is not supplied to the kneaded sand storage hopper 10.

When the height of the upper surface of kneaded sand is at a position that is greater than or equal to the kneaded sand level meter L 14 of the kneaded sand storage hopper 10, that is, in a state in which the kneaded sand storage hopper 10 is not empty and the upper surface of molding sand in the molding sand storage hopper 18 is at a position that is lower than the molding sand level meter M 20, the control unit 33 activates the belt conveyors 15, 16. The kneaded sand storage hopper 10 discharges kneaded sand onto the belt conveyors 15, 16, and then the belt conveyors 15, 16 convey kneaded sand to the crushing device 17.

The crushing device 17 crushes sand lumps in supplied kneaded sand, and supplies the crushed kneaded sand as molding sand to the molding sand storage hopper 18. When kneaded sand is introduced into the molding sand storage hopper 18 by way of the crushing device 17 and stored in the molding sand storage hopper 18, and the height of the upper surface of molding sand in the molding sand storage hopper 18 reaches the molding sand level meter H 19, the control unit 33 stops the discharging of kneaded sand from the kneaded sand storage hopper 10. After a prescribed amount of time has passed, the control unit 33 stops the belt conveyors 15, 16 at the point in time when the conveyance of kneaded sand on the belt conveyors 15, 16 has completed. The present step corresponds to the part in FIG. 3 where the amount of sand in the kneaded sand storage hopper 10 is decreasing and the amount of sand in the molding sand storage hopper 18 is increasing in accordance with a request that was transmitted when the amount of sand in the molding sand storage hopper 18 decreased from the molding sand level meter H 19 to the molding sand level meter M 20, as well as the part where the amount of sand in the kneaded sand storage hopper 10 stops decreasing when the amount of sand in the molding sand storage hopper 18 reaches the molding sand level meter H 19.

The molding sand storage hopper 18 successively supplies molding sand to the belt conveyor 22. If the amount of molding sand stored in the molding sand storage hopper 18 is greater than or equal to the molding sand level meter L 21, which will be described later in more detail, and there is a request for sand from the molding device 24, the control unit 33 controls the belt conveyor 22 so as to supply sand to the molding device 24. The molding sand property measuring instrument 23 measures the property of molding sand conveyed on the belt conveyor 22, and sends the measurement result to the control device 25. As described above, the molding sand batch number calculating unit 31 of the control device 25 calculates a kneaded batch number that corresponds to the molding sand having the received property, and stores in the storage unit 30 the molding sand property and the kneaded batch that corresponds thereto in association with each other.

The molding device 24 stops requesting for molding sand and performs molding when molding sand supplied through the belt conveyor 22 reaches an amount for one molding. When molding advances and the receiving of molding sand to be used for the next molding becomes possible, the molding device 24 will request for molding sand again. Thus, the control unit 33 operates the belt conveyor 22 again and controls the belt conveyor 22 so as to supply molding sand to the molding device 24.

When molding is repeatedly performed and the height of the upper surface of molding sand in the molding sand storage hopper 18 falls below the molding sand level meter M 20, the belt conveyors 15, 16 are operated and controlled so as to convey kneaded sand to the molding sand storage hopper 18, as described above.

Next, the effects of the kneaded sand property adjusting system 1 and property adjusting method described above will be described.

In the kneaded sand property adjusting system 1 and property adjusting method described above, regarding the molding sand whose molding sand property is being measured by the molding sand property measuring instrument 23, the kneaded batch number that corresponds to the molding sand is calculated by the molding sand batch number calculating unit 31 on the basis of the amount of kneaded sand measured by the kneaded sand amount measuring instruments 11, 12, 13, 14 provided in the kneaded sand storage hopper 10. Furthermore, the molding sand property and the kneaded sand property are associated with the temperature of sand before the sand is loaded into the kneading device 6 on the basis of the calculated kneaded batch number. That is, by obtaining the timing at which the kneaded sand of a given kneaded batch is used for molding as molding sand from the amount of sand stored in the conveyance process, the amount of change in a sand property from kneading to molding can be clearly understood. Thus, by controlling the property of kneaded sand by the amount of change, accurate kneading control becomes possible.

In addition, because the amount of kneaded sand stored in the conveyance process is determined by the kneaded sand amount measuring instruments 11, 12, 13, 14, which are level meters provided in the kneaded sand storage hopper 10 that measure the position of the upper surface of sand, the molding sand property and the kneaded sand property can be correctly associated. Thus, accurate kneading control becomes possible.

In addition, because the correction factor obtained by dividing the difference between the molding sand property and the kneaded sand property by the temperature of recovered sand loaded into the kneading device 6 is used to correct the kneaded sand target property and kneading is performed such that the property of kneading sand reaches the kneaded sand target property that was corrected, changes in the property of sand caused by the temperature of recovered sand can be appropriately dealt with. Thus, accurate kneading control becomes possible.

In addition, because the CB value, which has the most significant effect on moldability, is used as the property, stabilization of the moldability of green sand supplied to the molding machine can be attained.

In addition, because a moving average of a correction factor for correcting the kneaded sand target property is obtained and the kneaded sand target property is corrected using the moving average as the correction factor, the effects of abnormal sand property measurement values can be reduced. Thus, accurate kneading control becomes possible.

In addition, the kneaded sand property adjusting system 1 and property adjusting method of the present invention are not to be construed as being limited to the embodiment disclosed above that was explained with reference to drawings, and various other modified examples may be contemplated within the technical scope thereof.

For example, the property may be moisture content rather than the CB value.

In addition, in the embodiment described above, the recovered sand moisture and temperature measuring instrument 4 is provided on the belt of the belt feeder 3, but may also be disposed in the recovered sand weighing hopper 5.

In addition, in the embodiment described above, the recovered sand weighing hopper 5 is provided above the kneading device 6, but may be disposed underneath and a bucket elevator may be used to carry cut out sand to a kneading device 6 positioned above. The same applies to the other hoppers.

In addition, in the embodiment described above, the kneaded sand storage hopper 10 and the molding device 24 are placed apart, and kneaded sand from the kneaded sand storage hopper 10 is supplied to the molding device 24 through the belt conveyors 15, 16, the crushing device 17, the molding sand storage hopper 18, and the belt conveyor 22. Instead, if the molding device 24 can be arranged immediately below the kneaded sand storage hopper 10, the molding sand property measuring instrument 23 can be disposed on the belt conveyor 15, which receives kneaded sand cut out from the kneaded sand storage hopper 10, resulting in a configuration in which kneaded sand is supplied directly from the belt conveyor 15 to the molding device 24.

In such a configuration, the part pertaining to the molding sand storage hopper 18 can be deleted in FIG. 3, which shows the transition of the amount of sand in each operation process, and the kneaded sand level meter M 12 can be used as the criterion for kneaded batches, thus making it possible to achieve consistency between batches of kneaded sand and molding sand.

In addition to the above, it is possible to mix and match the configurations indicated in the embodiments described above and to appropriately modify the configurations to other configurations, without departing from the spirit of this invention.

REFERENCE SIGNS LIST

1 Kneaded sand property adjusting system
2 Recovered sand hopper
3 Belt feeder
4 Recovered sand moisture and temperature measuring instrument (sand temperature measuring instrument)
5 Recovered sand weighing hopper
6 Kneading device
7 Kneaded sand property measuring instrument
8 Water source
9 Water injection device
10 Kneaded sand storage hopper
11 Kneaded sand level meter H (kneaded sand amount measuring instrument)
12 Kneaded sand level meter M (kneaded sand amount measuring instrument)
13 Kneaded sand level meter ML (kneaded sand amount measuring instrument)
14 Kneaded sand level meter L (kneaded sand amount measuring instrument)
15 Belt conveyor
16 Belt conveyor
17 Crushing device
18 Molding sand storage hopper
19 Molding sand level meter H (molding sand amount measuring instrument)
20 Molding sand level meter M (molding sand amount measuring instrument)
21 Molding sand level meter L (molding sand amount measuring instrument)
22 Belt conveyor
23 Molding sand property measuring instrument
24 Molding device
25 Control device
30 Storage unit
31 Molding sand batch number calculating unit
32 Correcting unit
33 Control unit

The invention claimed is:

1. A kneaded sand property adjusting system comprising:
a batch kneading device;
a kneaded sand property measuring instrument that measures a property of the kneaded sand being kneaded;
a water injection device that injects water into the kneading device;
a kneaded sand storage hopper that stores the kneaded sand discharged from the kneading device;
a molding device that performs molding by using the kneaded sand discharged from and conveyed from the kneaded sand storage hopper as molding sand;
a control device that controls water injection by controlling the water injection device until the property of the kneaded sand in the kneading device meets a kneaded sand target property;
a kneaded sand amount measuring instrument that measures the amount of the kneaded sand stored in the kneaded sand storage hopper; and
a molding sand property measuring instrument that measures the property of the molding sand to be loaded into the molding device;
wherein the control device comprises:
a storage unit that stores a batch number of each kneaded batch and the kneaded sand property measured by the kneaded sand property measuring instrument in each kneaded batch in association with each other;
a molding sand batch number calculation unit that calculates the batch number of the kneaded batch that corresponds to the molding sand whose property is being measured by the molding sand property measuring instrument on the basis of the amount of the kneaded sand measured by the kneaded sand amount measuring instrument; and
a correcting unit that associates the molding sand property measured by the molding sand property measuring instrument with the kneaded sand property stored in the storage unit on the basis of the batch number that was calculated and corrects the kneaded sand target property on the basis of the values of the properties.

2. The kneaded sand property adjusting system according to claim 1, further comprising:

a molding sand storage hopper that stores the molding sand to be loaded into the molding device; and a molding sand amount measuring instrument that measures the amount of the molding sand stored in the molding sand storage hopper;

wherein the molding sand property measuring instrument measures the property of the molding sand discharged from the molding sand storage hopper.

3. The kneaded sand property adjusting system according to claim 1, wherein the kneaded sand amount measuring instrument is a level meter that measures the position of an upper surface of sand stored in the kneaded sand storage hopper.

4. The kneaded sand property adjusting system according to claim 1, further comprising:

a sand temperature measuring instrument that measures a temperature of sand before the sand is loaded into the kneading device;

wherein the storage unit further stores the batch number of each kneaded batch and the temperature measured by the sand temperature measuring instrument in each kneaded batch in association with each other; and the correcting unit calculates a correction factor by dividing the difference between the molding sand property and the kneaded sand property by the temperature associated with the batch number that was calculated and corrects the kneaded sand target property of the next kneaded batch to be kneaded on the basis of a value obtained by multiplying the correction factor by the temperature of sand of the next kneaded batch to be kneaded.

5. The kneaded sand property adjusting system according to claim 4, wherein the correcting unit calculates a moving average of the value obtained by dividing the difference by the temperature associated with the batch number that was calculated and uses the moving average as the correction factor.

6. The kneaded sand property adjusting system according to claim 1, wherein the property is a compactability value.

7. The kneaded sand property adjusting system according to claim 1, wherein the property is moisture content.

8. A kneaded sand property adjusting method comprising:

kneading the kneaded sand in a batch kneading device with the kneading device while injecting water into the kneading device until a property of the kneaded sand in the kneading device meets a kneaded sand target property;

measuring the property of the kneaded sand that was kneaded and storing a batch number of the kneaded batch and the kneaded sand property that was measured in association with each other;

storing the kneaded sand discharged from the kneading device in a kneaded sand storage hopper;

performing molding with a molding device using the kneaded sand discharged from and conveyed from the kneaded sand storage hopper as molding sand;

measuring the property of the molding sand to be loaded into the molding device;

measuring the amount of the kneaded sand stored in the kneaded sand storage hopper;

calculating the batch number of the kneaded batch that corresponds to the molding sand whose property is being measured on the basis of the amount of the kneaded sand that was measured; and associating the property of the molding sand that was measured with the kneaded sand property that was stored on the basis of the batch number that was calculated and correcting the kneaded sand target property on the basis of the values of the properties.

* * * * *